US010875151B2

(12) United States Patent
Grau et al.

(10) Patent No.: US 10,875,151 B2
(45) Date of Patent: Dec. 29, 2020

(54) VAPOR BLAST SYSTEM WITH FIXED POT PRESSURE

(71) Applicant: Graco Minnesota Inc., Minneapolis, MN (US)

(72) Inventors: Thomas C. Grau, Warminster, PA (US); Nicholas K. Studt, Roberts, WI (US); Brandon K. Falkenberg, New Richmond, WI (US); Bryce J. Gapinski, Foley, MN (US); John W. Turner, Coon Rapids, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 195 days.

(21) Appl. No.: 15/745,013

(22) PCT Filed: Jul. 15, 2016

(86) PCT No.: PCT/US2016/042585

§ 371 (c)(1),
(2) Date: Jan. 15, 2018

(87) PCT Pub. No.: WO2107/011780

PCT Pub. Date: Jan. 19, 2017

(65) Prior Publication Data

US 2018/0207769 A1 Jul. 26, 2018

Related U.S. Application Data

(60) Provisional application No. 62/193,235, filed on Jul. 16, 2015.

(51) Int. Cl.
*B24C 7/00* (2006.01)

(52) U.S. Cl.
CPC ..... *B24C 7/0023* (2013.01); *B24C 7/0038* (2013.01); *B24C 7/0084* (2013.01)

(58) Field of Classification Search
CPC .... B24C 7/0023; B24C 7/0038; B24C 7/0084
(Continued)

(56) References Cited

U.S. PATENT DOCUMENTS 5,024,029 A 6/1991 Abbot et al.
5,230,185 A * 7/1993 Kirschner ..... B24C 7/0053 451/38

(Continued)

FOREIGN PATENT DOCUMENTS

CN 1038235 A 12/1989
CN 1038425 A 1/1990

(Continued)

OTHER PUBLICATIONS

International Search Report and Written Opinion for PCT/US2016/042585, dated Sep. 12, 2016, 11 pages.

(Continued)

*Primary Examiner* — George B Nguyen
(74) *Attorney, Agent, or Firm* — Kinney & Lange, P. A.

(57) ABSTRACT

A vapor abrasive blast system includes a pump for pumping a water stream to a pressure vessel for pressurizing the pressure vessel to a pot pressure. A water regulator is disposed to regulate the water stream to a fixed water pressure, such that the water stream entering the pressure vessel has the fixed water pressure. The pressure vessel contains a blasting mixture, comprising an abrasive media and water, for introduction to a compressed air stream and application to a substrate. The water entering the pressure vessel has the fixed water pressure to control the pot pressure. The water regulator is configured to output the water stream such that the fixed water pressure is greater than a compressed air pressure in the compressed air stream.

20 Claims, 5 Drawing Sheets

(58) Field of Classification Search
USPC ..... 451/38
See application file for complete search history.

(56) References Cited

U.S. PATENT DOCUMENTS

| | | | | |
|---|---|---|---|---|
| 5,239,788 | A | 8/1993 | Woodson | |
| 5,412,910 | A * | 5/1995 | Woodson | B05B 7/1404 451/38 |
| 5,421,767 | A | 6/1995 | Spears, Jr. et al. | |
| 5,441,441 | A * | 8/1995 | Cook | B08B 3/02 451/36 |
| 5,484,325 | A | 1/1996 | Shank | |
| 5,545,074 | A | 8/1996 | Jacobs | |
| 5,865,902 | A | 2/1999 | Yam et al. | |
| 6,659,844 | B2 * | 12/2003 | Shaw | B24C 1/003 451/37 |
| 6,719,612 | B2 | 4/2004 | Visaisouk et al. | |
| 6,896,597 | B2 * | 5/2005 | Dore | B24C 7/0038 451/91 |
| 6,905,396 | B1 * | 6/2005 | Miller | B24C 1/086 451/38 |
| 7,147,545 | B2 * | 12/2006 | Gadd | B24B 57/00 451/38 |
| 7,186,167 | B2 * | 3/2007 | Joslin | B24C 1/045 451/102 |
| 7,544,112 | B1 * | 6/2009 | Miller | B24C 1/086 451/10 |
| 7,669,449 | B1 * | 3/2010 | Sundstrom | C21D 7/06 239/690.1 |
| 8,764,513 | B1 | 7/2014 | Spears | |
| 8,905,816 | B2 * | 12/2014 | Gramling | B24C 3/00 451/2 |
| 9,393,672 | B2 | 7/2016 | Eliason | |
| 9,925,642 | B2 | 3/2018 | Eliason | |
| 10,076,823 | B2 * | 9/2018 | Eliason | B24C 7/003 |
| 10,434,630 | B2 * | 10/2019 | Turner | B24C 7/0007 |
| 10,449,657 | B2 | 10/2019 | LeCompte | |
| 10,471,570 | B2 | 11/2019 | Trull, Jr. et al. | |
| 2001/0051493 | A1 * | 12/2001 | Kelton | B24C 3/065 451/36 |
| 2002/0168924 | A1 | 11/2002 | Visaisouk et al. | |
| 2009/0081928 | A1 * | 3/2009 | Fujiwara | F42B 33/067 451/38 |
| 2012/0015592 | A1 | 1/2012 | Eliason | |
| 2013/0324016 | A1 | 12/2013 | Eliason | |
| 2015/0105001 | A1 | 4/2015 | Eliason | |
| 2016/0193715 | A1 | 7/2016 | Nash | |

FOREIGN PATENT DOCUMENTS

| | | | |
|---|---|---|---|
| CN | 1615207 | A | 5/2005 |
| CN | 108602174 | A | 9/2018 |
| DE | 604737 | C | 10/1934 |
| DE | 8804578 | U1 | 5/1988 |
| DE | 4212615 | C1 | 5/1993 |
| EP | 1075352 | B1 | 5/2003 |
| EP | 1450988 | B1 | 10/2005 |
| GB | 2196279 | A | 4/1988 |
| WO | WO9522432 | A1 | 8/1995 |
| WO | WO 2015042032 | A1 | 3/2015 |
| WO | WO 2017011780 | A1 | 1/2017 |
| WO | WO2017151541 | A1 | 9/2017 |

OTHER PUBLICATIONS

Extended European Search Report for EP Application No. 16825270.8, dated Feb. 21, 2019, pp. 11.
First Chinese Office Action for CN Application No. 201680041518.7, dated Dec. 13, 2019, pp. 24.
Second Chinese Office Action from CN Application No. 201680041518.7, dated Aug. 5, 2020, pp. 21.

* cited by examiner

VAPOR BLAST SYSTEM WITH FIXED POT PRESSURE

CROSS-REFERENCE TO RELATED APPLICATION

This application is a National Stage Application based on PCT/US2016/042585 filed Jul. 15, 2016, which claims priority to U.S. Provisional Application No. 62/193,235 filed on Jul. 16, 2015, and entitled "Vapor Blast System with Fixed Pot Pressure Setting."

BACKGROUND

Blasting systems in the surface preparation industry generally use dry, wet, slurry, vapor abrasive, or ultra-high pressure water blast technologies to remove dirt, paint, or rust from a substrate. Vapor blast systems use a mixture of air, water, and an abrasive media—such as garnet or walnut shells—to provide the desired surface treatment. Vapor blast systems often include a pump and a pressure vessel containing an abrasive media having a density greater than water. Pumping water to the pressure pot pressurizes it and allows the abrasive media and water to mix. The pressurized media and water mixture is then plumbed into a conduit of a high flowing air stream to mix the two streams before expelling the mixture from a hose and nozzle. To ensure that the media and water mixture can be injected into the high flowing air stream, the pressure inside the pressure pot must be higher than the pressure in the air stream. Existing designs need the user to set the pressure in the air stream and to set the pressure in the pressure pot. Users typically set a desired air stream pressure and then have to set the pressure pot pressure. If the differential is too low, there will be no influx of the media and water mixture into the air stream, or there could be a back lux of air into the pressure pot.

SUMMARY

According to an aspect of the disclosure, a blasting system includes a pressure vessel, a water line extending from a water source and connected to the pressure vessel, a water pump disposed on the water line, a water regulator disposed on the water line, and a blast line. The pressure vessel is configured to house a blast media and water mixture. The water line provides water to the pressure vessel. The water pump drives a flow of water from the water source to the pressure vessel. The water regulator is configured to receive the flow of water and to output a pressure regulated water flow having a regulated flow pressure. The regulated flow pressure pressurizes the pressure vessel to a pressure vessel pressure. The blast line conveys a compressed air flow at an air pressure, and the compressed air flow is configured to receive a flow of the media and water mixture from the pressure vessel. The pressure vessel pressure is greater than the air pressure.

According to another aspect of the disclosure, a method of blasting a substrate with a media includes regulating a water flow pressure with a water regulator to generate a regulated water flow, pumping the regulated water flow to a pressure vessel to pressurize the pressure vessel to a pressure vessel pressure having a fixed pressure point, compressing an air stream to a blast pressure and flowing the air stream through a blast line and to a blasting apparatus, and flowing media and water from the pressure vessel and into the air stream within the blast line and applying the combined flow of media, water, and air to a substrate. The blast pressure is within a range between a minimum blast pressure and a maximum blast pressure. The fixed pressure point is greater than the maximum blast pressure.

According to yet another aspect of the disclosure, a vapor blast assembly includes a pressure vessel mounted to a support structure, an enclosure mounted to the support structure, and a water regulator disposed within the enclosure and configured to generate a regulated water flow. The enclosure is configured to receive a flow of compressed air from a compressed air source, to receive a flow of water from a water source and to provide the regulated water flow to the pressure vessel, to receive a combined flow of media and water from the pressure vessel, and to output a combined flow of compressed air, water, and media. A regulated water flow pressure maintains a pressure vessel pressure above a compressed air pressure such that a pressure differential between the pressure vessel pressure and the compressed air pressure drives the combined flow of media and water into the flow of compressed air to generate the combined flow of compressed air, water, and media.

DETAILED DESCRIPTION

Figure 1:
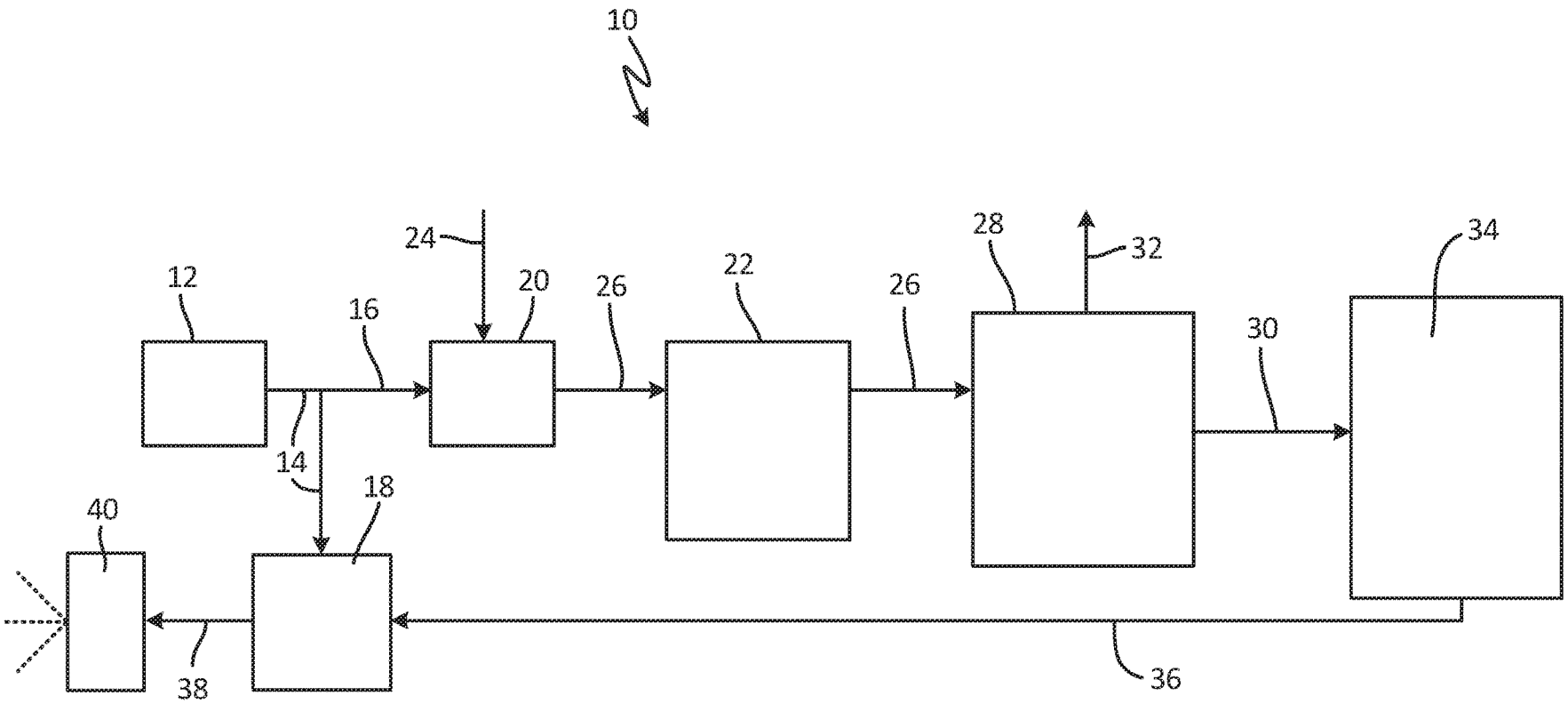
FIG. 1 is a schematic view of a vapor blast system.

FIG. 1 is a schematic view of vapor blast system 10. Vapor blast system 10 includes compressor 12, air supply line 14, system line 16, manifold line 18, water pump 20, water regulator 22, water inlet line 24, pumped water line 26, selector valve 28, pressurizing line 30, accessory line 32, pressure vessel 34, media line 36, blast line 38, and applicator 40.

Air supply line 14 extends from compressor 12 and receives compressed air from compressor 12. System line 16 extends from air supply line 14 and to water pump 20 to provide compressed air to water pump 20 to power water pump 20. Manifold line 18 extends from air supply line 14 and to blast line 38. Blast line 38 extends from manifold line 18 and to applicator 40. Water inlet line 24 is connected to water pump 20. Water pump 20 is also connected to pumped water line 26 and drives water downstream through water regulator 22 and pumped water line 26. Water regulator 22 is connected to pumped water line 26, and pumped water line 26 extends to selector valve 28. Pressurizing line 30 and accessory line 32 extend from selector valve 28. Accessory line 32 extends to an accessory, such as a rinse hose. Pressurizing line 30 extends from pumped water line 26 and to pressure vessel 34. Media line 36 extends from pressure vessel 34 and intersects manifold line 18.

Pressure vessel 34 contains a blast mixture, comprised of media and water, which is applied to a substrate to remove a coating from the substrate and to condition the substrate for future coating applications. The media may be of any suitably abrasive material such as walnut shells, crushed glass, garnet, or any other heavier-than-water particulate, and may be applied to any desired substrate, such as wood, concrete, and steel, to clean the substrate. Compressor 12 provides compressed air to air supply line 14. A blasting air portion of the compressed air flows through manifold line 18, downstream past the intersection of manifold line 18 and media line 36, and through blast line 38 to applicator 40. A system air portion of the compressed air flows through system line 16 and is provided to water pump 20. The system air portion of the compressed air flows through system line 16 and to water pump 20 to power water pump 20. Water pump 20 draws water from a water source (not shown) through water inlet line 24 and drives the pumped water flow downstream through pumped water line 26. The pumped water is driven through water regulator 22 and continues downstream through pumped water line 26 and to selector valve 28. While water regulator 22 is shown downstream of water pump 20, it is understood that water regulator 22 may be at any desired position downstream of water pump 20 and before pressure vessel 34, such as on pumped water line 26 between water pump 20 and selector valve 28 or on pressurizing line 30 downstream of selector valve 28.

Water regulator 22 regulates a water pressure of any water pumped downstream of water pump 20 through water regulator 22. As such, water pump 20 draws water through water inlet line 24 and pumps the pumped water downstream at a pumped water pressure higher than a maximum blast air pressure required for vapor blast system 10 operation. Water regulator 22 generates a regulated water flow, having a fixed water pressure, such that a pressure downstream of water regulator 22 is fixed. The regulated water flow flows downstream from water regulator 22 through pumped water line 26 and to selector valve 28. Selector valve 28 directs the regulated water to pressurizing line 30 and accessory line 32. Accessory line 32 provides the regulated water to an accessory, such as a rinse hose. Pressurizing line 30 provides the regulated water to pressure vessel 34.

The regulated water enters pressure vessel 34 through pressurizing line 30. Because the regulated water has the fixed water pressure flowing the regulated water to pressure vessel maintains a fixed pot pressure within pressure vessel 34. When applicator 40 is triggered, the blast mixture disposed within pressure vessel 34 exits pressure vessel 34 through media line 36, and flows through media line 36 to manifold line 18. When applicator 40 is triggered, the blast mixture enters manifold line 18 through media line 36 and is combined with the blast air portion in manifold line 18 to generate an applicator flow. The blast air portion carries the blast mixture downstream to blast line 38, and downstream through blast line 38 to applicator 40. The applicator flow is then accelerated through applicator 40, such as by flowing the mixture through a nozzle, and applied to a substrate. The media impacts the substrate and is configured to remove material, such as paint, from the substrate and to condition the substrate for subsequent application of material to the substrate.

During operation, media and water are loaded into pressure vessel 34 to generate the blast mixture, and pressure vessel 34 is sealed. Compressor 12 is activated, and the system portion of compressed air flows to water pump 20 through system line 16 to power water pump 20. With water pump 20 powered, water pump 20 drives the pumped water downstream through pumped water line 26 and water regulator 22, and water regulator 22 outputs the regulated water flow. The regulated water flow flows downstream to selector valve 28, and selector valve 28 directs the regulated water flow through pressurizing line 30 and into pressure vessel 34. Because the regulated water flow has a fixed water pressure, the fixed water pressure pressurizes pressure vessel 34 to a fixed pot pressure, with the fixed pot pressure being controlled by the fixed water pressure.

With pressure vessel 34 loaded and pressurized, applicator 40 is triggered and air supply line 14 is able to provide the blast air portion of compressed air to manifold line 18. Because the fixed pot pressure is greater than the maximum blast air pressure, the blast mixture exits pressure vessel 34 through media line 36 and flows to manifold line 18. In addition to opening air supply line 14, triggering applicator 40 causes media line 36 to open such that the blast mixture may flow from pressure vessel 34 and to manifold line 18 through media line 36. A pressure differential between the blast air portion flowing through manifold line 18 and the fixed pot pressure causes the media and water mixture to flow from pressure vessel 34 and into manifold line 18. To ensure that vapor blast system 10 operates correctly, the pressure differential must be maintained such that the fixed pot pressure is higher than the blast air pressure. If the pot pressure is below the blast air pressure, then the blast mixture would be prevented from entering manifold line 18 due to the higher blast air pressure. When applicator 40 is applying the blast mixture, the regulated water continues to flow to pressure vessel 34 to maintain a pot pressure above the blast air pressure. With applicator 40 triggered, the pot pressure will drop to a level proximate the blast air pressure, but the regulated water continues to flow to pressure vessel 34 to replace the blast mixture flowing out of pressure vessel 34 and to continue pressurizing pressure vessel 34. As such, the regulated water maintains the pot pressure higher than the blast air pressure regardless of the level that the blast air pressure is set.

When applicator 40 is deactivated, the blast air portion is prevented from flowing to manifold line 18 and the blast mixture is also prevented from flowing to manifold line 18. With media line 36 closed and water pump 20 continuing to pump water, the pot pressure rises to the fixed pot pressure, because water regulator 22 continues to supply the regulated water to pressure vessel 34. Once the pot pressure reaches the fixed pot pressure, the pressure downstream of water regulator 22 will cause internal components of water regulator 22 to shift to prevent the pot pressure from continuing to rise. Water regulator will then allow additional flow when the pot pressure drops due to applicator 40 being triggered.

Water regulator 22 maintains the fixed pot pressure higher than the maximum blast air pressure. In addition, water regulator 22 maintains the pot pressure greater than the operational blast air pressure during operation. Water regulator 22 may be set to output regulated water at a fixed water pressure point, dependent on the dimensions and particular arrangement of the components of vapor blast system 10, such that the fixed water pressure point is always higher than the maximum blast air pressure. More specifically, water regulator 22 is configured to maintain the fixed pot pressure safely above the maximum blast air pressure, and to maintain the pot pressure above the blast air pressure during operation. In this way, water regulator 22 thereby ensures that the pressure differential causes the blast mixture to flow into manifold line 18 from pressure vessel 34.

Water regulator 22 maintaining the fixed pot pressure provides significant advantages. Utilizing water regulator 22 eliminates a step in the setup process, whereby the user was required to set the pot pressure and compare the pot pressure against the blast air pressure to discern whether the differential was sufficient. Water regulator 22 instead ensures that the pot pressure will be sufficiently high for vapor blast system 10 operation, thereby allowing the user to set the desired blast air pressure without being concerned about the pot pressure and eliminating potential user error and a time-consuming step. Moreover, positioning water regulator 22 downstream of water pump 20 further eliminates user misconceptions, as water regulator 22 will dampen any pressure fluctuations that may occur due to water pump 20 changing stroke or the inherent differential between an upstroke and a downstroke. As such, water regulator 22 further provides a consistent blast mixture flow, because the pot pressure will be maintained at a steady pressure throughout the blasting process. Providing a steady blast mixture flow increases the consistency of the blast pattern, which improves the consistency of the surface finish created by the media blasting on the substrate. Water regulator 22 also thereby eliminates misconceptions of poor blasting performance due to the user observing natural fluctuations in the pot pressure and interpreting the fluctuations as malfunctions or errors. Instead, water regulator 22 maintains the pot pressure at a steady pressure relative to the blast pressure during blasting, and at the fixed pot pressure when vapor blast system 10 idles.

Figure 2B:
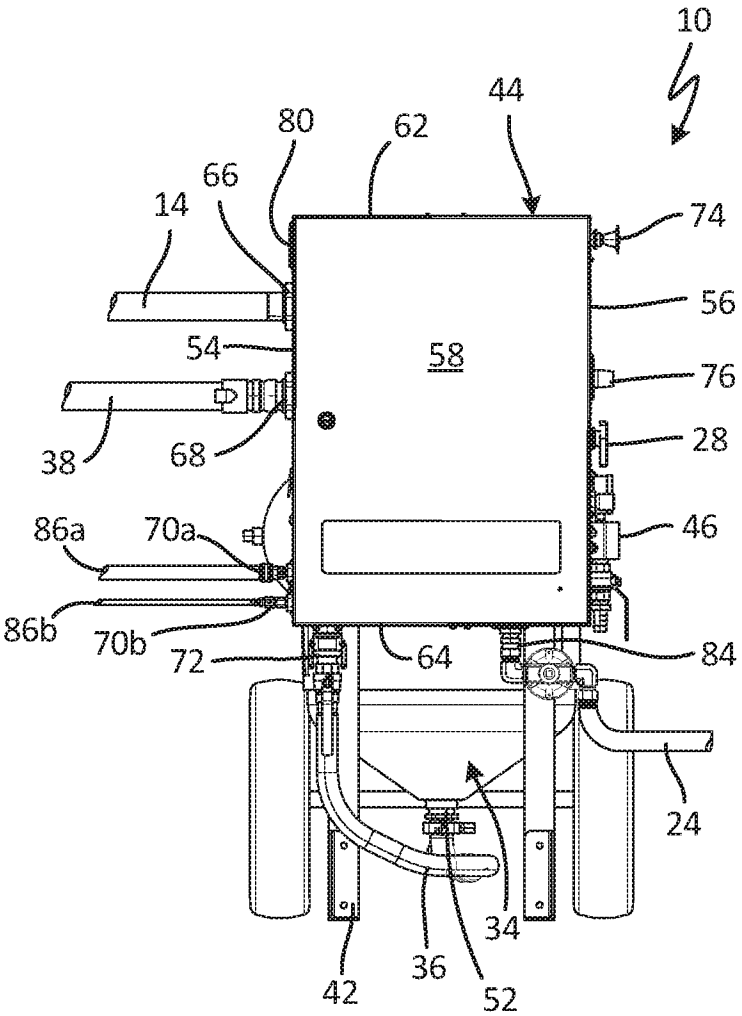
FIG. 2B is a front elevation view of the vapor blast assembly of FIG. 2A.
Figure 2A:
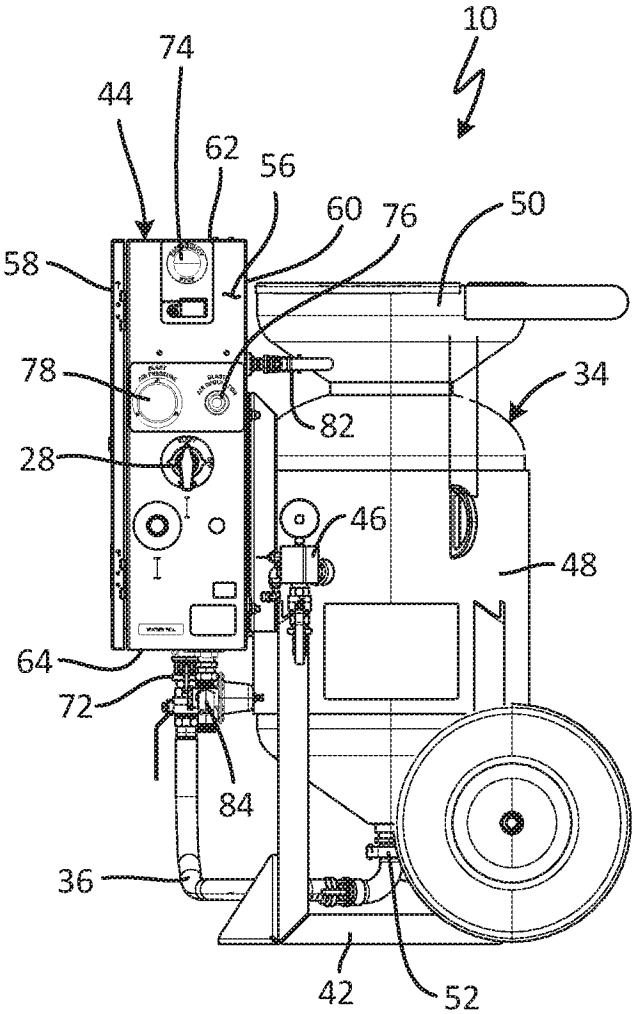
FIG. 2A is a side elevation view of a vapor blast assembly.

FIG. 2A is a side elevation view of vapor blast system 10. FIG. 2B is a front elevation view of vapor blast system 10. FIGS. 2A and 2B are substantially similar and will be discussed together. Vapor blast system 10 includes air supply line 14, water inlet line 24, pressure vessel 34, media line 36, blast line 38, frame 42, enclosure 44, and pot pressure gauge 46. Pressure vessel 34 includes pressure pot 48 and fill inlet 50. Pressure pot 48 includes media outlet port 52. Enclosure 44 includes first side 54, second side 56, front 58, back 60, top 62, and bottom 64. Vapor blast system 10 further includes selector valve 28, air inlet port 66, blast outlet port 68, control ports 70*a* and 70*b*, media inlet port 72, disconnect 74, blast air control 76, blast pressure gauge 78, inlet air pressure gauge 80, accessory outlet port 82, water inlet port 84, control line 86*a* and control line 86*b*.

Pressure vessel 34 and enclosure 44 are mounted to frame 42. Fill inlet 50 extends from a top of pressure pot 48. Media inlet port 72 extends into enclosure 44 and is configured to receive a blast mixture flow from media line 36. Media line 36 extends between media outlet port 52 and media inlet port 72 and connects pressure vessel 34 and enclosure 44. Pot pressure gauge 46 is disposed between pressure vessel 34 and enclosure 44, and the regulated water flows through pot pressure gauge 46 between enclosure 44 and pressure vessel 34. Air supply line 14 is connected to air inlet port 66 to provide compressed air to enclosure 44. Air inlet port 66 extends through first side 54 of enclosure 44. Inlet air pressure gauge 80 extends through first side 54 of enclosure 44 and is configured to provide a reading of the inlet air pressure entering enclosure 44 through air inlet port 66. Blast line 38 is connected to blast outlet port 68, which extends from first side 54 of enclosure, and is configured to receive an applicator flow from enclosure 44. Accessory outlet port 82 extends from back 60 of enclosure 44 and is configured to receive an accessory hose. Water inlet port 84 extends from bottom 64 of enclosure 44, and water inlet line 24 connects to water inlet port 84.

Control ports 70*a* and 70*b* extend from first side 54 of enclosure 44. Control line 86*a* extends from control port 70*a*, and control line 86*b* extends from control port 70*b*. Control line 86*a* and control line 86*b* extend to applicator 40 (shown in FIG. 1) and are normally disconnected. When applicator 40 is triggered, control line 86*a* is connected to control line 86*b* to provide compressed air from control line 86*a* to control line 86*b* and back to enclosure 44 to actuate vapor blast system 10 between an active state and an idle state. Selector valve 28 extends into second side 56 of enclosure 44 and is configured to direct a regulated water flow through enclosure 44. Disconnect 74 extends through second side 56 of enclosure 44 and is connected to pneumatic lines disposed within enclosure 44. Disconnect 74 is a knob that is configured to be extended during operation, and may be depressed to disconnect the compressed air flow through enclosure 44, thereby deactivating vapor blast system 10. Blast air control 76 extends through second side 56 of enclosure 44 and is connected to pneumatic lines disposed within enclosure 44 to control the blast air pressure. Blast pressure gauge 78 extends through second side 56 of enclosure 44 and provides a blast air pressure reading to the user.

Pressure pot 48 of pressure vessel 34 is filled with a media and water through fill inlet 50. Air supply line 14 is connected to air inlet port 66 and provides compressed air to the pneumatic lines (shown in FIG. 3C) disposed within enclosure 44. The compressed air enters enclosure 44, and blast air control 76 is utilized to control a blast air portion flow between air inlet port 66 and blast outlet port 68. Before activating vapor blast system 10, the user pulls disconnect 74 to the disengaged position. With disconnect 74 disengaged, the system air portion is able to flow to and power water pump 20 (best seen in FIGS. 3A-3C). Triggering applicator 40 connects control line 86*a* extending from control port 70*a* with control line 86*b* extending from control port 70*b*, and control line 86*a* and control line 86*b* cause both air supply line 14 and media line 36 to open such that both compressed air and media flow to and through enclosure 44.

Water pump 20 pulls water into enclosure 44 through water inlet line 24 and water inlet port 84. Water pump 20 drives the water downstream through water regulator 22 (best seen in FIGS. 3A-3C), and water regulator 22 discharges regulated water at a fixed water pressure. The regulated water flows through selector valve 28, which the user sets to direct the regulated water to either pot pressure gauge 46 and then on to pressure pot 48, or to accessory outlet port 82. With vapor blast system 10 in a blast mode, the selector valve 28 is set to direct the regulated water through pot pressure gauge 46 and to pressure pot 48. The regulated water has the fixed water pressure and flows to pressure pot 48 to pressurize pressure pot 48 to a fixed pot pressure.

Pressure pot 48 is initially charged to the fixed pot pressure. The regulated water flows into pressure pot 48 through pot pressure gauge 46, and pot pressure gauge 46 provides a pot pressure reading to the user. The regulated water pressurizes pressure pot 48 to the fixed pot pressure, at a level configured to be above a maximum blast air pressure. The pot pressure reading indicates to the user that pressure pot 48 is pressurized for blasting. While the fixed water pressure is described as being fixed above a maximum blast air pressure, it is understood that water regulator 22 may be set such that any desired fixed water pressure is provided downstream of water regulator 22. As such, while water regulator 22 is generally set to provide the fixed water pressure prior to a user receiving vapor blast system 10, it is understood that water regulator 22 may be configured to be either fixed before user operation or adjustable by the user.

With media line 36 and manifold line 18 (best seen in FIGS. 3A-3C) open, the pot pressure drops from the fixed pot pressure to a level proximate, though still above, the blast air pressure. A pressure differential between the blast air pressure and the pot pressure causes the blast mixture to flow out of pressure pot 48 through media outlet port 52 and into media line 36. The pressure differential further causes the blast mixture to enter enclosure 44 through media inlet port 72, and to flow into manifold line 18 to combine with the blast air portion and form the applicator flow. The applicator flow exits enclosure 44 through blast outlet port 68 and flows through blast line 38 to applicator 40, where the applicator flow is applied to a substrate. During operation, pot pressure gauge 46 will indicate to the user that the pot pressure has dropped below the fixed pot pressure, but the pot pressure reading will also indicate that the pot pressure is being maintained at a level proximate, but still above, the blast air pressure, which is set by the user.

Water regulator 22 maintains the regulated water flow throughout the blast process. The regulated water flows to pressure pot 46 and maintains the pot pressure above the blast air pressure. Maintaining the pot pressure above the blast air pressure ensures a consistent flow of blast mixture to applicator 40. In addition, the regulated water flow returns the pot pressure to the fixed pot pressure when applicator 40 is deactivated such that vapor blast system 10 is idling. With applicator 40 deactivated, the regulated water flow maintains the pot pressure at the fixed pot pressure, preferably above a maximum blast air pressure, which ensures that the blast mixture will flow to manifold line 18 and downstream through blast line 38 regardless of the blast air pressure set by the user.

Figure 3A:
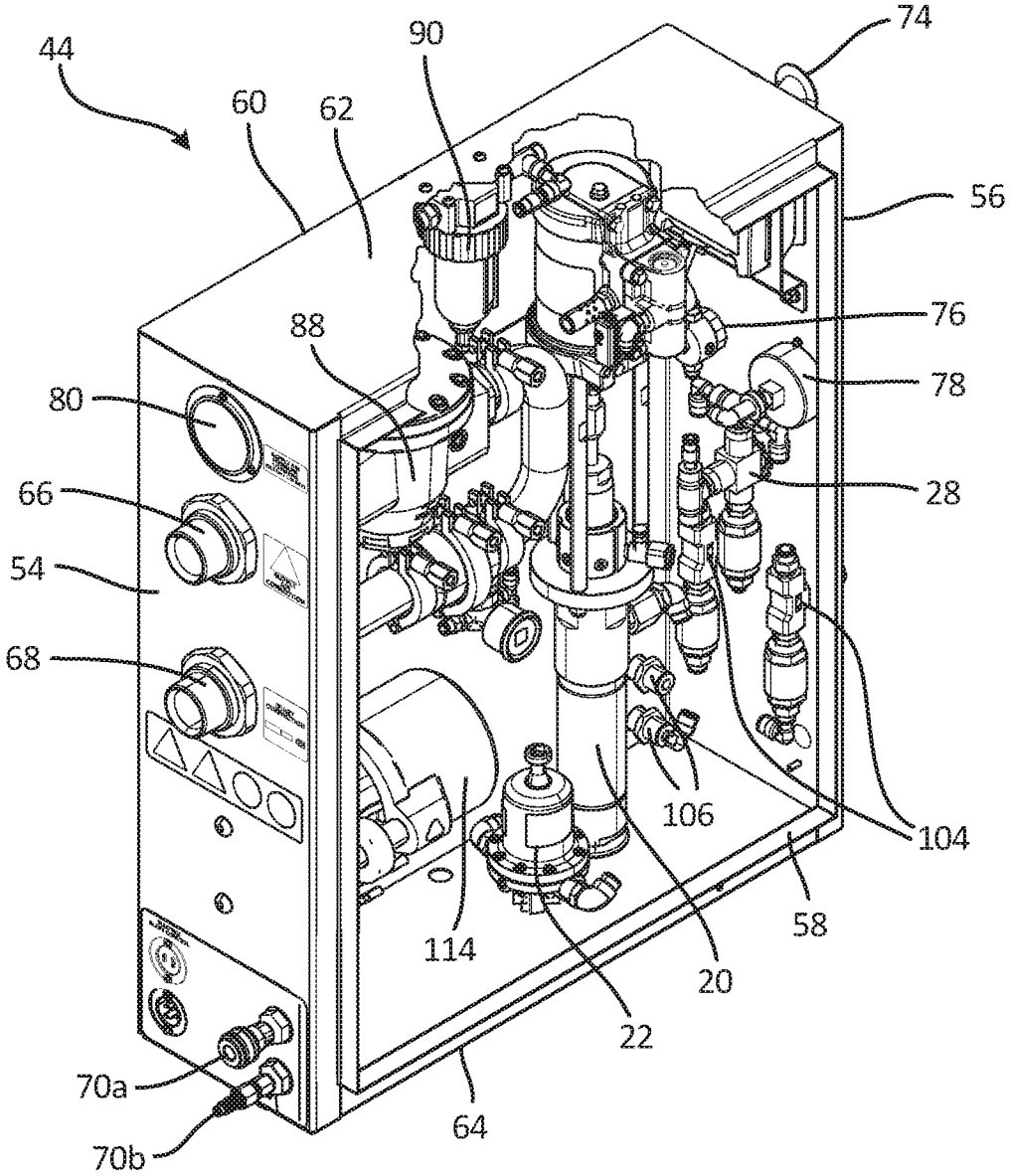
FIG. 3A is a hose side facing isometric view of an enclosure.
Figure 3B:
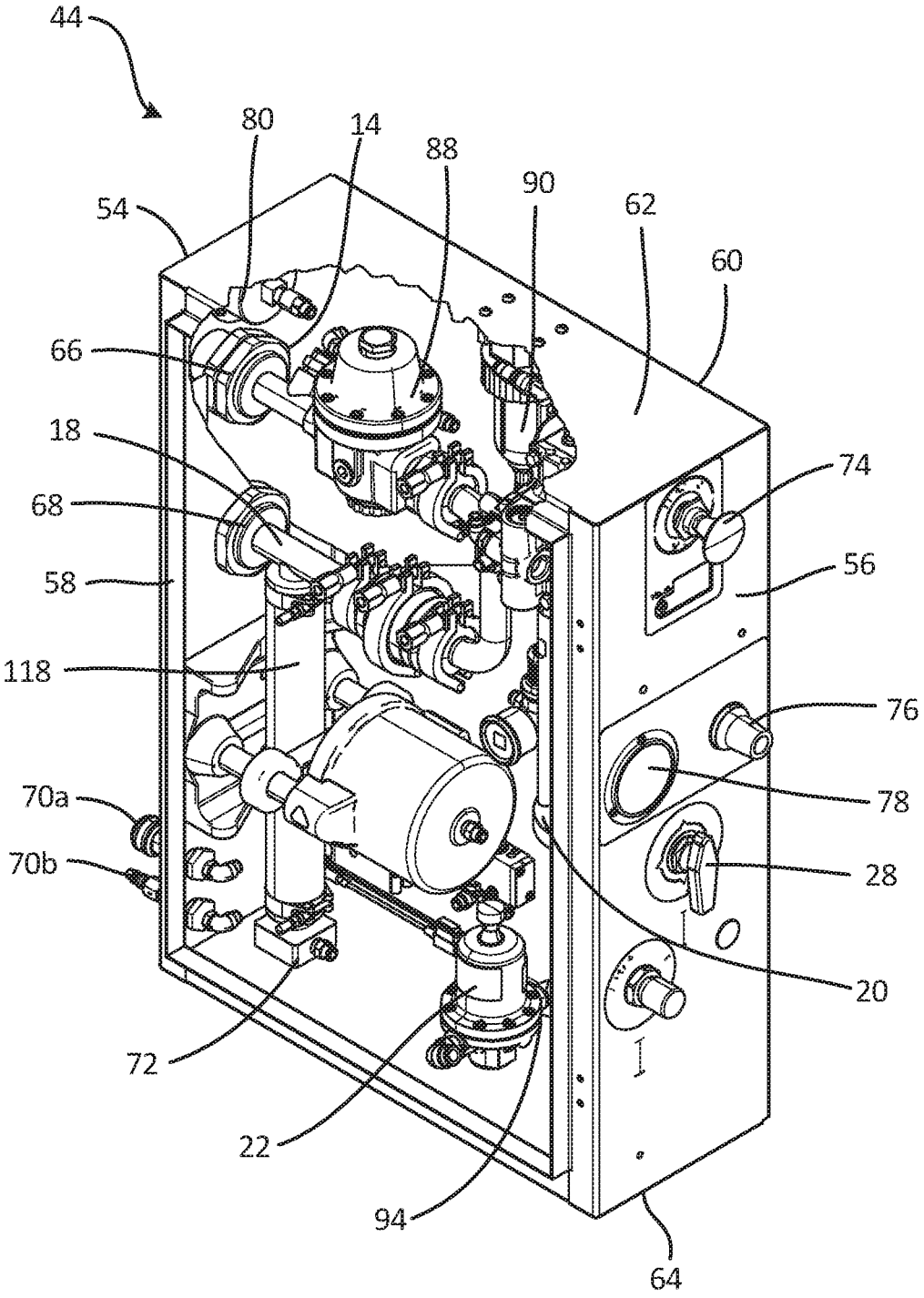
FIG. 3B is a control side facing isometric view of the enclosure of FIG. 3A.
Figure 3C:
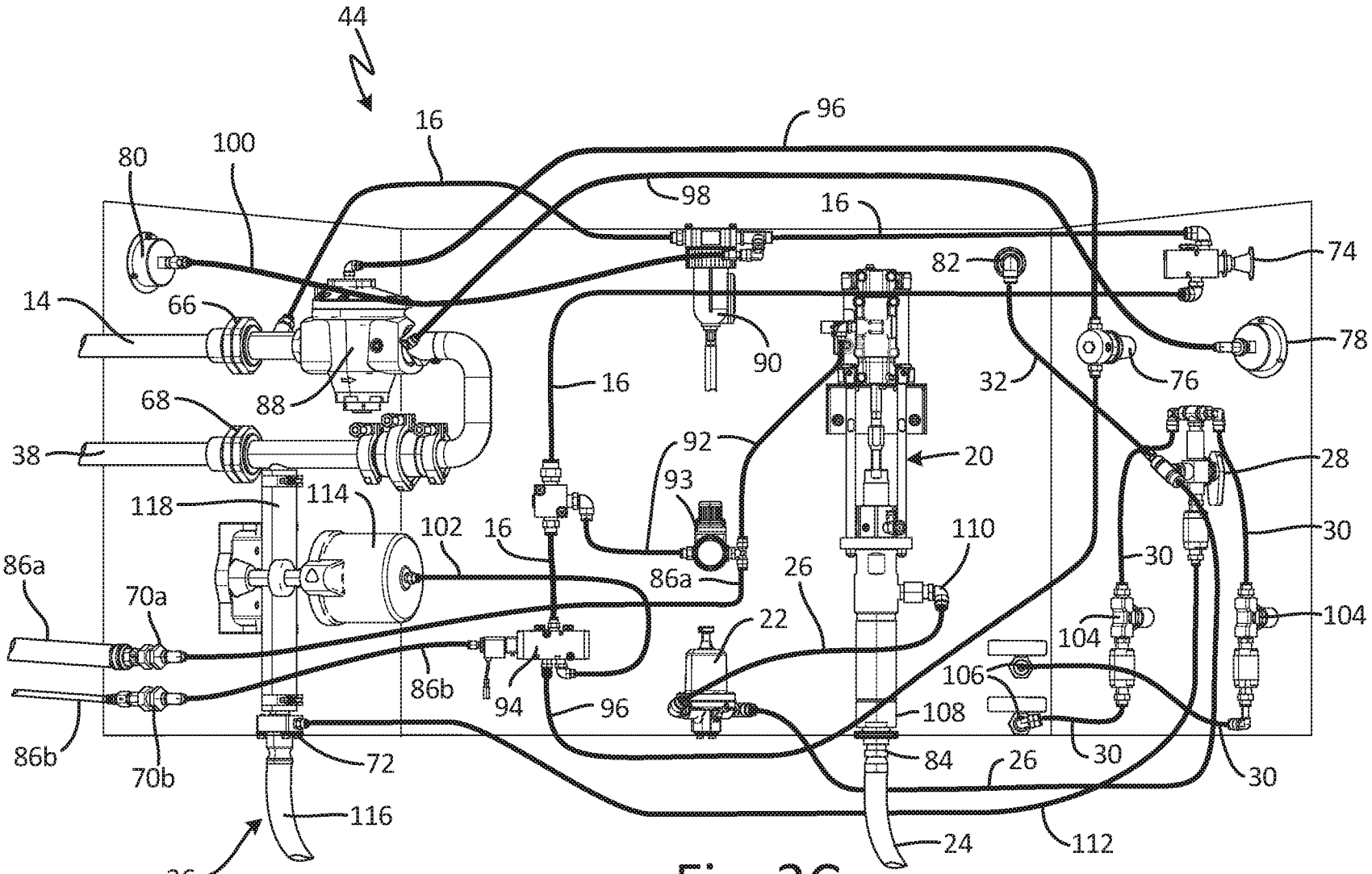
FIG. 3C is a schematic view showing tubing connections within the enclosure of FIG. 3A.

FIG. 3A is a hose side facing front isometric view of enclosure 44. FIG. 3B is a control side facing front isometric view of enclosure 44. FIG. 3C is a schematic view showing tubing connections within enclosure 44. Enclosure 44 includes first side 54, second side 56, front 58, back 60, top 62, and bottom 64. A pneumatic portion includes air supply line 14, system line 16, air inlet port 66, control ports 70*a* and 70*b*, disconnect 74, blast air control 76, blast pressure gauge 78, inlet air pressure gauge 80, air regulator 88, filter 90, pump control line 92, control line 86*a*, control line 86*b*, control valve 94, air regulator line 96, blast pressure gauge line 98, inlet pressure gauge line 100, and flow valve line 102. A hydraulic portion includes water pump 20, water regulator 22, water inlet line 24, pumped water line 26, selector valve 28, pressurizing lines 30, accessory line 32, accessory outlet port 82, water inlet port 84, needle valves 104, pot supply outlet ports 106, and wash line 112. Water pump 20 includes pump inlet 108 and pump outlet 110. A blast portion includes manifold line 18, media line 36, blast line 38, blast outlet port 68, media inlet port 72, and valve 114. Media line 36 includes conveying hose 116 and flow hose 118.

Air inlet port 66 extends through first side 54 of enclosure 44 and is connected to air supply line 14. Air supply line 14 extends to air regulator 88, through which compressed air flows. Manifold line 18 extends from air regulator 88 and to blast outlet port 68, and blast outlet port 68 extends through first side 54 of enclosure 44. Blast line 38 extends from blast outlet port 68 and to applicator 40 (shown in FIG. 1). System line 16 is connected to and extends from air supply line 14 upstream of air regulator 88. System line 16 extends to filter 90, to disconnect 74, to pump control line 92, and to control valve 94. Pump control line 92 extends from system line 16 upstream of control valve 94 and to water pump 20. Pump control line 92 conveys a part of the system air portion to water pump 20 to power water pump 20. Air regulator 93 is disposed on pump control line 92 upstream of water pump 20 and is configured to regulate a pressure of the part of the system air portion to generate a regulated system air portion provided to water pump 20 to power water pump 20.

Control line 86*a* extends from pump control line 92 and to control port 70*a*. Control line 86*a* extends outside of enclosure 44 from control port 70*a* and to applicator 40. Control line 86*b* extends from control valve 94 and to control port 70*b*. Similar to control line 86*a*, control line 86*b* also extends outside of enclosure 44 from control port 70*b* to applicator 40. Triggering applicator 40 connects control line 86*a* and control line 86*b* such that the system air portion may flow through control line 86*a*, to control line 86*b*, and to control valve 94 to actuate control valve 94 based on a trigger position.

Flow valve line 102 extends from control valve 94 and to flow valve 114. Air regulator line 96 extends from control valve 94 and to air regulator 88. Blast air control 76 is connected to air regulator line 96 and is configured to control the air flow to air regulator 88 through air regulator line 96, to thereby control the volume and pressure of the blast air portion allowed to flow downstream through air regulator 88. With both flow valve line 102 and air regulator line 96 attached to control valve 94, triggering applicator 40 causes control valve 94 shift between a first position and a second position to control an airflow through flow valve line 102 and air regulator line 96. For example, with applicator 40 not triggered, control valve 94 may direct air through flow valve line 102 to flow valve 114, thereby actuating flow valve 114 to the closed position. At the same time, control valve 94 prevents air from flowing through air regulator line 96, thereby maintaining air regulator 88 in a normally closed position. When applicator 40 is triggered, air is directed through air regulator line 96 and prevented from flowing through flow valve line 102, and as such, air regulator 88 is opened by the airflow through air regulator line 96 and flow valve 114 is opened because flow valve line 102 is depressurized.

Water inlet port 84 extends through bottom 64 of enclosure 44. Water inlet port 84 receives water inlet line 24 at pump inlet 108, and pumped water line 26 extends from pump outlet 110 and downstream to selector valve 28. Water regulator 22 is disposed on pumped water line 26 between water pump 20 and selector valve 28. While water regulator 22 is described as disposed between water pump 20 and selector valve 28, it is understood that water regulator may be placed at any desired location downstream of water pump 20 and upstream of pressure vessel 34, such as on pumped water line 26 or pressurizing lines 30.

Accessory line 32 extends from selector valve 28 and to accessory outlet port 82. Pressurizing lines 30 extends from selector valve 28 and to needle valves 104, and pressurizing lines 30 extends from needle valves 104 and to pot supply outlet ports 106. Wash line 112 extends from selector valve 28 to media inlet port 72. While two pressurizing lines 30 are shown, it is understood that vapor blast system 10 may include as few or as many pressurizing lines 30 for conveying regulated water to pressure vessel 34 (best seen in FIGS. 2A and 2B). Pressurizing lines 30 extend through needle valves 104, and needle valves 104 control a regulated water flow into pressure vessel 34. As such, needle valves 104 are utilized to control the flow of regulated water into pressure vessel 34 thereby controlling a blast mixture flow out of pressure vessel 34. Therefore, while water regulator 20 controls a water pressure of the regulated water, needle valves 104 control a flow of the regulated water.

Media inlet port 72 extends through bottom 64 of enclosure 44. Manifold line 18 extends from air regulator 88 and to blast outlet port 68, and blast outlet port 68 extends through first side 54 of enclosure 44, similar to air inlet port 66. Blast line 38 extends from blast outlet port 68 and to applicator 40. Media line 36 extends from pressure vessel 34, through media inlet port 72, and to manifold line 18 to provide a blast mixture to manifold line 18 to generate an applicator flow comprised of compressed air, media, and water. More specifically, conveying hose 116 extends from pressure pot 48 and to media inlet port 72, and flow hose 118 extends from media inlet port 72 and to manifold line 18. Flow valve 114 is configured to the blast mixture flow through flow hose 118, such that the blast mixture flow is prevented from entering manifold line 18 when flow valve 114 is in a first position and the blast mixture flow flows to manifold line 18 when flow valve 114 is in a second position. For example, flow valve 114 may be a pinch valve and flow hose 118 may be a pinch hose, such that in the first position flow valve 114 compressed flow hose 118 to close any flow opening through flow hose 118, and in the second position flow valve 114 disengages from flow hose 118 to allow the blast mixture flow through flow hose 118.

Pressure vessel 34 is loaded with a supply of media and water by a user, thereby generating the blast mixture. The user disengages disconnect 74, thereby permitting the system air portion to flow through system line 16 between air supply line 14 and control valve 94. Compressor 12 (shown in FIG. 1) provides a compressed air flow to air regulator 88 through air inlet port 66 and air supply line 14. Air regulator 88 controls a compressed air flow through blast line 38, and is configured to be positionable at any desired position between a closed position, fully preventing compressed air from flowing through air regulator 88, and an open position, allowing a maximum blast air pressure through air regulator 88. When the compressor 12 is activated, the system air portion is provided through system line 16 regardless of the position of air regulator 88.

The system air portion flows to control valve 94 and to control line 86*a*. The system air portion is also provided through pump control line 92 to power water pump 20, such that pumped water is provided downstream of water pump 20 whenever compressor 12 is activated, regardless of if applicator 40 is triggered. The system portion also flows through control line 86*a* and to applicator 40. Before applicator 40 is triggered, a part of the system air portion flows into control valve 94 through system line 16. The part of the system air portion provided to control valve 94 through system line 16 is directed to either flow valve line 102 to shift flow valve 114 to the first position where metering hose 118 is closed, or air regulator line 96 to shift air regulator 88 to an open position to allow the blast air portion to flow to manifold line 18. With control line 86*a* disconnected from control line 86*b*, the part of the system air portion is directed to flow valve line 102, such that both flow valve 114 and air regulator 88 are closed.

With flow valve 114 and air regulator 88 closed, water pump 20 continues to drive water downstream through pumped water line 26 and to water regulator 22 to generate the regulated water. The regulated water is provided to pressure vessel 34 through pressurizing lines 30 to pressurize pressure vessel 34 to the fixed pot pressure, which is controlled by the fixed water pressure of the regulated water. The regulated water maintains the pot pressure at the fixed pot pressure whenever compressor 12 is activated and flow valve 114 is closed.

When applicator 40 is triggered, control line 86*a* is connected to control line 86*b* such that compressed air is provided to control valve 94 through control line 86*b*. The compressed air flowing through control line 86*b* actuates control valve 94 such that compressed air may flow through air regulator line 96 and actuate air regulator 88 to an open position such that compressed air may flow to blast line 38 through air regulator 88. At the same time, control valve 94 shifting prevents compressed air from flowing to flow valve 114 through flow valve line 102. As such, the pressure maintaining flow valve 114 in the first position is relieved, and the blast mixture is allowed to flow through flow hose 118.

Blast pressure gauge 78 is connected to air regulator 88 by blast gauge line 98, and blast pressure gauge 78 provides the user with a blast air pressure reading. Blast air control 76 allows a user to adjust the air provided through air regulator line 96, such that the blast air portion allowed through air regulator 88 is set by the user. With air regulator 88 opened, the blast air portion is able to flow downstream through air regulator 88 and to manifold line 18.

With both flow valve 114 and air regulator 88 open, the blast mixture is combined with the blast air portion in manifold line 18. The combined blast mixture and blast air portion are provided to blast line 38 and downstream to applicator 40 to be applied to a substrate. With flow valve 114 open, the blast mixture flows out of pressure vessel 34 and water pump 20 drives water into pressure vessel 34 to replace the blast mixture flowing out of pressure vessel 34. The blast mixture flowing to manifold line 18 causes the pot pressure to drop below the fixed pot pressure. Water regulator 22 is configured to output regulated water having the fixed water pressure, and the regulated water flows downstream from water regulator 22, through pumped water line 26, to selector valve 28, and through pressurizing lines 30 and needle valves 104 and to pressure vessel 34. The regulated water maintains the pot pressure at a level proximate, but still above, the blast air pressure. As such, the user will notice that the pot pressure has dropped, but that the pot pressure is maintained at a steady level relative to the blast air pressure, such that a differential between the pot pressure and the blast air pressure drives the blast mixture through media line 36 and to manifold line 18.

Water regulator 22 regulates the regulated water pressure to maintain the pot pressure at a level greater than the blast air pressure throughout the vapor blast process. For example, water regulator 22 may include internal components, such as a diaphragm and poppet valve, configured to shift along with the upstream to downstream pressure differential about water regulator 22, to allow the regulated water to flow through water regulator 22 to control the pot pressure. By controlling the pot pressure such that the pot pressure is always greater than the blast air pressure, water regulator 22 eliminates any need for the user to set the pot pressure and ensures that the pot pressure is always safely above the blast air pressure. As such, water regulator 22 ensures that the blast mixture will always flow into manifold line 18 to combine with the blast air portion.

Disengaging the trigger on applicator 40 disconnects control line 86*a* from control line 86*b*, thereby disconnecting the airflow to control valve 94. With the airflow to selector valve 28 through control line 86*b* shut off, air is prevented from flowing through air regulator line 96 and is directed through flow valve line 102. Flow valve 114 thus closes, preventing the blast mixture flow through flow hose 118. Closing flow hose 118 causes the pot pressure to rise within pressure vessel 34 and thus in pressurizing lines 30 and pumped water line 26. The pot pressure continues to rise until the pot pressure reaches the fixed pot pressure, which then causes water regulator 22 to cut off any additional water flow through water regulator 22, thereby ensuring that the fixed pot pressure is maintained at the fixed water pressure. When flow valve 114 shifts to the open position, the blast mixture exits pressure vessel 34 leading to a drop in the pot pressure, and the drop in the pot pressure causes water regulator 22 to allow additional water to flow to pressure vessel 34 to maintain the pot pressure above the blast air pressure. While water regulator 22 maintains the fixed pot pressure above the maximum blast air pressure, it is understood that the pot pressure may drop below the maximum blast air pressure during operation, but water regulator 22 ensures that the pot pressure is always above the blast air pressure actually utilized during blasting.

Although the present invention has been described with reference to preferred embodiments, workers skilled in the art will recognize that changes may be made in form and detail without departing from the spirit and scope of the invention.

The invention claimed is:

1. A blasting system comprising:

a pressure vessel configured to house a blast media;

a water line connected to the pressure vessel to provide water to the pressure vessel;

a water pump disposed on the water line and configured to drive a flow of water to the pressure vessel;

a water regulator disposed on the water line, wherein the water regulator is configured to output a pressure regulated water flow having a regulated flow pressure, wherein the regulated flow pressure pressurizes the pressure vessel to a pressure vessel pressure;

an air supply line extending from a compressed air source and configured to provide a compressed air flow;

an air line configured to convey the compressed air flow at an air pressure, wherein the air line extends to a blast line configured to receive a flow of media and water from the pressure vessel via a media line extending from the pressure vessel to the blast line and mix the flow of media and water with the compressed air flow;

a system line extending from the air line to a control valve, the system line configured to receive a system portion of the compressed air flow from the air line;

a first air pressure regulator disposed on the air line upstream of the blast line and downstream of an intersection between the system line and the air line;

a regulator line extending from the control valve to the first air pressure regulator;

a flow valve line extending from the control valve to a flow valve disposed on the media line upstream of the connection of the media line and the blast line, wherein the flow valve is actuatable between an open state, during which media and water can flow to the blast line, and a closed state, during which media and water are prevented from flowing to the blast line;

wherein the control valve is actuatable between a first state, where the system air is directed to the regulator line and prevented from flowing to the flow valve line, and a second state, where the system air is directed to the flow valve line and prevented from flowing to the regulator line;

wherein the first air pressure regulator is normally closed and the flow valve is normally open;

wherein the pressure vessel pressure is greater than the air pressure.

2. The blasting system of claim 1, wherein the water regulator is located downstream of the water pump.

3. The blasting system of claim 1, wherein the flow valve comprises a pinch valve.

4. The blasting system of claim 1, and further comprising:

a selector valve disposed downstream of the water pump, wherein the selector valve is configured to direct the water flow downstream of the selector valve.

5. The blasting system of claim , wherein the selector valve is configured to direct the pressure regulated water flow to one of the pressure vessel and an accessory line.

6. The blasting system of claim 5, wherein the water regulator is disposed downstream of the selector valve and upstream of the pressure vessel.

7. The blasting system of claim 4, wherein the selector valve is a three-way valve.

8. The blasting system of claim 1, and further comprising:

a metering valve positioned downstream of the water regulator and configured to receive the pressure regulated water flow from the water regulator and meter a flow of the pressure regulated water flow to the pressure vessel.

9. A method of blasting a substrate with a media, the method comprising:

regulating a water flow pressure with a water regulator to generate a regulated water flow;

pumping the regulated water flow to a pressure vessel to pressurize the pressure vessel to a pressure vessel pressure having a fixed pressure point;

compressing an air stream and flowing the compressed air stream to a first air pressure regulator;

regulating a pressure of the compressed air stream to a blast pressure with the first air pressure regulator to generate a regulated air flow;

flowing the regulated air flow through a blast line and to a blasting apparatus, wherein the blast pressure is within a range between a minimum blast pressure and a maximum blast pressure; and flowing media and water from the pressure vessel and into the regulated air flow within the blast line and applying the combined flow of media, water, and air to a substrate, wherein the fixed pressure point is greater than the maximum blast pressure;

controlling the flow of media and water from the pressure vessel and into the regulated air flow with a flow valve disposed on a media line extending between the pressure vessel and the blast line;

flowing a system portion of the compressed air stream tapped from a location upstream of the air pressure regulator to a control valve; and actuating the control valve between a first state, where the control valve directs the system portion to the air pressure regulator, and a second state, where the control valve directs the system air to the flow valve;

wherein the air pressure regulator is normally closed such that directing the system portion to the air pressure regulator causes the air pressure regulator to open; and wherein the flow valve is normally open such that directing the system portion to the flow valve causes the flow valve to close.

10. The method of claim 9, wherein a pressure differential between the fixed pressure point and the blast pressure drives the media and water flow into the air stream.

11. The method of claim 9, wherein the step of pumping the regulated water flow to the pressure vessel to pressurize the pressure vessel to the pressure vessel pressure having the fixed pressure point further comprises:

flowing a water flow to the water regulator, wherein the water regulator generates the regulated water flow; and wherein the water regulator is disposed downstream of a water pump configured to pump the water to the pressure vessel.

12. The method of claim 11, wherein the water regulator is disposed downstream of a selector valve configured to direct the water to the pressure vessel.

13. The method of claim 12, wherein the step of pumping the regulated water flow to the pressure vessel to pressurize the pressure vessel to the pressure vessel pressure having the fixed pressure point further comprises:

flowing a pump portion of the system portion of the compressed air stream to a second air pressure regulator to generate a regulated pump air; and flowing the regulated pump air to a water pump to power the water pump.

14. The method of claim 9, wherein the step of pumping the regulated water flow to the pressure vessel to pressurize the pressure vessel to the pressure vessel pressure having the fixed pressure point further comprises:

flowing a pump portion of the system portion of the compressed air stream to a water pump to power the water pump, wherein the system portion has a fixed air pressure that causes the water pump to output the regulated water flow.

15. A vapor blast system comprising:

a pressure vessel mounted to a support structure;

an enclosure mounted to the support structure, wherein the enclosure is configured to receive a flow of compressed air from a compressed air source, to receive a flow of water from a water source and to provide a regulated water flow to the pressure vessel, to receive a combined flow of media and water from the pressure vessel, and to output a combined flow of compressed air, water, and media;

a water regulator disposed within the enclosure and configured to generate the regulated water flow; and a first air regulator disposed within the enclosure and configured to generate a regulated air flow, the regulated air flow configured to mix with the water and media from the pressure vessel at a location within the enclosure and downstream of the first air regulator, wherein the first air regulator is normally closed and configured to be pneumatically actuated from closed to open;

a blast line disposed downstream of the first air regulator and configured to receive the regulated air flow from the first air regulator and the combined flow of media and water from a flow line, wherein an intersection between the flow line and the blast line is disposed within the enclosure;

a flow valve disposed within the enclosure and on the flow line, wherein the flow valve is normally open and configured to be pneumatically actuated from open to closed;

a system line disposed within the enclosure and extending to a control valve, wherein the system line is connected to the flow of compressed air at a location within the enclosure and upstream of the first air regulator to receive a system portion of the compressed air flow;

a flow valve line extending from the control valve to the flow valve, the flow valve line disposed within the enclosure;

a regulator line extending from the control valve to the first air regulator, the regulator line disposed within the enclosure;

wherein the regulated water flow maintains a pressure vessel pressure above a regulated air flow pressure such that a pressure differential between the pressure vessel pressure and the regulated air flow pressure drives the combined flow of media and water into the regulated air flow to generate the combined flow of compressed air, water, and media; and wherein the control valve is actuatable between a first state, where the system portion is directed to the regulator line and prevented from flowing to the flow valve line, and a second state, where the system portion is directed to the flow valve line and prevented from flowing to the regulator line.

16. The vapor blast system of claim 15, wherein the enclosure further comprises:

a housing mounted to the frame;

a compressed air line extending into a first side of the housing;

wherein the blast line extends from the first air regulator and exits the housing through a blast media outlet extending through the first side;

a pump control line extending to a water pump, and configured to provide a pump control portion of the system portion to the water pump to power the water pump;

a water inlet line extending to the water pump and configured to provide a flow of water to the water pump;

a pressurization line extending from an outlet of the water pump and configured to provide the regulated water flow to the pressure vessel;

a blast media inlet extending into the enclosure and configured to receive a media hose extending from the pressure vessel; and wherein the flow hose extends from the blast media inlet and intersects the blast line;

wherein the water regulator is disposed on the pressurization line between the water pump and the pressure vessel, such that the water regulator receives a pump outlet water flow from the water pump and generates the regulated water flow.

17. The blasting system of claim 1, further comprising:

a pump control line extending from the system line to the water pump.

18. The blasting system of claim 17, further comprising:

a second air pressure regulator disposed within the enclosure and on a pump control line extending from the system line to the water pump, wherein the second air pressure regulator is configured to generate a regulated system air flow configured to power the water pump.

19. The blasting system of claim 1, wherein each of the water regulator, the water pump, the first air pressure regulator, the intersection between the system line and the air line, the system line, the regulator line, the flow valve line, the flow valve, and the control valve are disposed within a common enclosure.

20. The vapor blast system of claim 16, further comprising:

a second air regulator disposed within the enclosure and on the pump control line, wherein the second air regulator is configured to generate a regulated system air flow configured to power the water pump.

* * * * *